US007406846B2

(12) United States Patent
Chu

(10) Patent No.: US 7,406,846 B2
(45) Date of Patent: Aug. 5, 2008

(54) ELECTROMECHANICAL LOCK EMPLOYING SHAPE MEMORY METAL WIRE

(75) Inventor: John Wun-Sing Chu, Cupertino, CA (US)

(73) Assignee: Nanotechnology, Inc., Cupertino, CA (US)

( * ) Notice: Subject to any disclaimer, the term of this patent is extended or adjusted under 35 U.S.C. 154(b) by 24 days.

(21) Appl. No.: 11/128,094

(22) Filed: May 11, 2005

(65) Prior Publication Data

US 2005/0252260 A1 Nov. 17, 2005

Related U.S. Application Data

(60) Provisional application No. 60/570,847, filed on May 12, 2004.

(51) Int. Cl.
*E05B 49/00* (2006.01)

(52) U.S. Cl. ..... 70/278.7; 70/278.1

(58) Field of Classification Search ..... 70/278.7
See application file for complete search history.

(56) References Cited

U.S. PATENT DOCUMENTS 5,351,042 A 9/1994 Aston
5,542,274 A 8/1996 Thordmark et al.
5,977,858 A 11/1999 Morgen et al.
6,000,609 A 12/1999 Gokcebay et al.
6,008,992 A 12/1999 Kawakami
6,073,469 A * 6/2000 Julien ..... 70/38 A
6,310,411 B1 10/2001 Viallet
6,374,653 B1 4/2002 Gokcebay et al.
2004/0035687 A1 * 2/2004 von Behrens et al. ..... 200/6 C

* cited by examiner

*Primary Examiner*—Patricia Engle
*Assistant Examiner*—Kristina R Gluchowski

(57) ABSTRACT

An electronic lock incorporating one or more shape memory metal wire segment as its electromechanical transducer. An electronic control circuit injects electrical current into the shape memory metal wire, causing it to heat up and contract. A gate is positioned by the action of the shape memory metal wire(s) to either allow or block the movement of a locking bolt that affect locking or unlocking. Millions of operational cycles are achieved by limiting the stretching of the shape memory metal wire at low temperature to small percentages of its total length. The design lends itself to miniaturization, with commensurate reduction in power consumption, that is useful to the evolution of future electronic locks.

16 Claims, 7 Drawing Sheets

ELECTROMECHANICAL LOCK EMPLOYING SHAPE MEMORY METAL WIRE

CROSS-REFERENCE TO RELATED APPLICATION

This application is a non-provisional application and claims the benefit of Application No. 60/570,847, filed May 12, 2004, which application is incorporated herein in its entirety by this reference.

FIELD OF THE INVENTION

The present invention relates generally to an electromechanical lock and in particular an electromechanical lock incorporating shape memory metal wire as the electromechanical transducer.

BACKGROUND OF THE INVENTION

Unlike most other electronic products, electronic locks must be exceedingly rugged to withstand severe physical abuse. This prerequisite imposes a lower limit beyond which critical mechanical components can no longer be arbitrarily made smaller. For reliable performance, forces driving these mechanical components necessarily must have large safety margins. Most existing electromechanical locks employ as transducers electromagnetic devices such as electromagnets, solenoids or motors to translate electrical signals into mechanical outputs. For example, U.S. Pat. No. 5,542,274 (Thordmark et al.) discloses a cylinder lock in which an electric motor is used to move a blocking element. U.S. Pat. Nos. 6,000,609 and 6,374,653 B1 (both Gokcebay et al.) disclose an electronic lock using a solenoid to move a blocking pin. In U.S. Pat. No. 5,351,042 (Aston) one of the ways to keep a locking bar from blocking the barrel of the lock from turning is by energizing an electromagnet which in turn keeps the locking bar from dropping into a recess in the barrel.

Besides having the usual drawbacks of high power consumption, susceptibility to vibration and external magnetic field (electromagnet and solenoid), these conventional electromagnetic devices can only be made small to a degree before forces produced by them become too feeble to be useful. Furthermore, manufacturing of ever smaller electromagnetic devices soon becomes prohibitively costly.

Certain metal alloys, such as TiNi, can be deformed at low temperature and then returned to their original shape after heating. This shape memory effect requires that a martensitic phase change to occur, and that the specific volumes of the martensite (the low temperature phase) and austenite (the high temperature phase) in the alloys are effectively equal. When in the martensitic condition, deformation strains can be "stored" through a mechanical twinning process. The austenite phase cannot accommodate these twins, so that when the material in the martensitic condition is heated and reverts to austenite (this occurs from about 70 to 120 degrees centigrade for commercial shape memory metal wire), the deformed material must also return to its original shape. Fine wires made of shape memory metal TiNi and sold by Dynalloy, Inc. of Costa Mesa, Calif., USA have tensile strength equal to that of stainless steel. Heating a TiNi wire stretched under tension can produce very large pull forces, e.g., a wire of 0.012" in diameter can produce a maximum pull of 1.25 kg! These shape memory metal wires can also be made extremely fine. Off-the-shelf stocks from Dynalloy, Inc. can go as fine as 0.0015" in diameter. Shape memory metal wire therefore lends itself to miniaturization.

Shape memory metal wire is used in some prior art to activate actuators. In U.S. Pat. No. 5,977,858 (Morgen et al.) two separate shape memory segments are used to move a leaf spring from one to the other steady states, which thereby closes or opens an electrical circuit, or causes a cantilever to close or open an electrical circuit.

Shape memory metal wire is also employed as the electromechanical transducer in electronic locks in some prior art, as in U.S. Pat. No. 6,008,992 (Kawakami) and U.S. Pat. No. 6,310,411 B1 (Viallet). In both patents, shape memory metal wire is used to directly move a locking bolt. Both patents deal with situations in which external electrical power is available to either operate the lock or to recharge the battery that operates the lock; hence, high power consumption is not a problem. If such arrangement is adapted for use in a high traffic, hard-wired door lock, it would take a sizable backup battery to ensure proper performance in an electrical blackout. Worse yet, if they are used in a stand-alone, battery-powered electromechanical lock, battery life would be unacceptably short.

In U.S. Pat. No. 5,351,042 (Aston), a shape memory metal wire is anchored at one end to a tension spring and at the other end to a locking bar. The position of this locking bar either allows or blocks the turning of the plug inside a lock cylinder. There are two problems with this arrangement. First, soldering or welding cannot be used to join the shape memory metal wire to the spring because heat from the process would destroy the shape memory metal wire. If adhesive is used instead, the joint would not hold over many operation cycles. That leaves us with the most common method of joining shape memory metal wire with anchors, namely crimping, riveting, eyelet-setting or screw tightening. At such tiny scale it is extremely difficult, if not impossible, to perform such joining.

Second, even though shape memory metal wire can be stretched as much as 8% at low temperature and subsequently recovers when heated, it would fail to function after a relatively few, e.g. under 100, cycles. For reliable performance over an acceptable number of cycles the stretching of the shape memory metal wire at low temperature must be kept to some low percentages of its total length. In general, 5-6% stretch would produce wire life of tens of thousands of cycles; at 3-4% stretch, hundreds of thousands of cycles and at under 2% stretch, millions of cycles. Since in the Aston invention the tension spring absorbs part of the contraction and force intended for moving the locking bar, it is necessary to substantially increase the contraction and force of the shape memory metal wire to compensate for this absorption. Further increase in contraction and force is needed to compensate for tension spring variations. Such increase in contraction and force makes it necessary to use longer and thicker shape memory metal wire, which takes up more room and consumes more energy.

SUMMARY OF THE INVENTION

A better solution, as presented in the present invention, is to get rid of the tension spring. Not only anchoring the shape memory metal wire directly or non-elastically to the background or components of sizable bulk of the lock is much easier than to a tension spring, controlling the amount of stretching of the shape memory metal wire at low temperature to a certain percentage of its total length is quite straightforward.

According to another aspect of the invention, a second shape memory metal wire segment may be arranged to contract concurrently with opposite force to that caused by contraction of the first shape memory metal wire segment used for controlling the locking action when ambient temperature rises above the transition temperature of the shape memory metal wires so that the lock does not become unlocked due to ambient temperature changes.

With electronics ever shrinking in size and increasing in complexity, it is conceivable to be able to ultimately pack all the electronics in an electromechanical lock into a single integrated circuit chip. For many future electromechanical lock applications, it is most desirable to have an electromechanical transducer that can be miniaturized cost-effectively, and yet one that retains sufficient force for the task. The electromechanical transducer disclosed in this invention can achieve this goal because there is no reason why, at least in some embodiments, all components constituting the transducer cannot be manufactured cost-effectively with micromachining and assembled manually or with robotics. Such miniaturization also leads to commensurate reduction in power consumption. To further reduce electrical energy consumption, in some embodiments, a fine and short shape memory metal wire can be used to move a much smaller and lighter gate over a much shorter distance, instead of the larger and heavier locking bolt over a much longer distance. The position of the gate is preferably used to either allow or thwart the movement of the locking bolt. Long operational life is achieved by preferably limiting the stretching of the shape memory metal wire at low temperature to low percentages of its total length, such as not more than about 6% in some of the embodiments.

Some of the possible forms and functions of future electromechanical locks incorporating such transducers include, but are not limited to: solar or self-powered electronic locks; small electronic padlocks; electronic lock cylinders that convert mechanical locks to electronic locks by replacing the original cylinders; stand-alone, battery-powered electronic fingerprint locks with long battery life.

Accordingly, my invention can cost-effectively provide an electromechanical transducer that lends itself to miniaturization, and yet one that produces force sufficient to perform tasks required of electronic locks. It is not susceptible to vibration or external magnetic fields and has low power consumption.

Further advantages of my invention will become apparent from a consideration of the drawings and ensuing description.

BRIEF DESCRIPTION OF THE DRAWINGS

In the drawings, closely related figures have the same number but different alphabetic suffixes, and components with the same or similar function have the same numerals in this application.

DESCRIPTION OF THE PREFERRED EMBODIMENTS

Figure 1A:
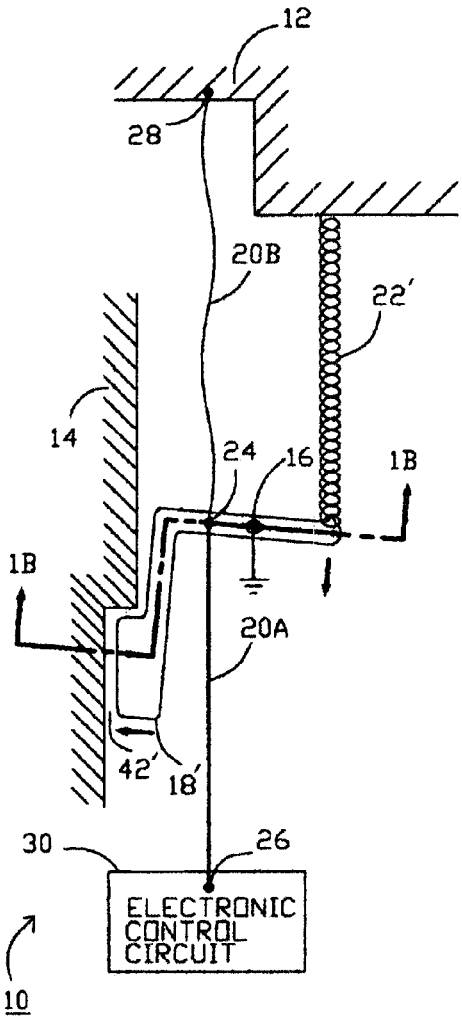
FIG. 1A in plan view, and FIG. 1B in endwise cross-sectional view, show the electronic lock in locked and unlocked (dashed lines) states.
Figure 1C:
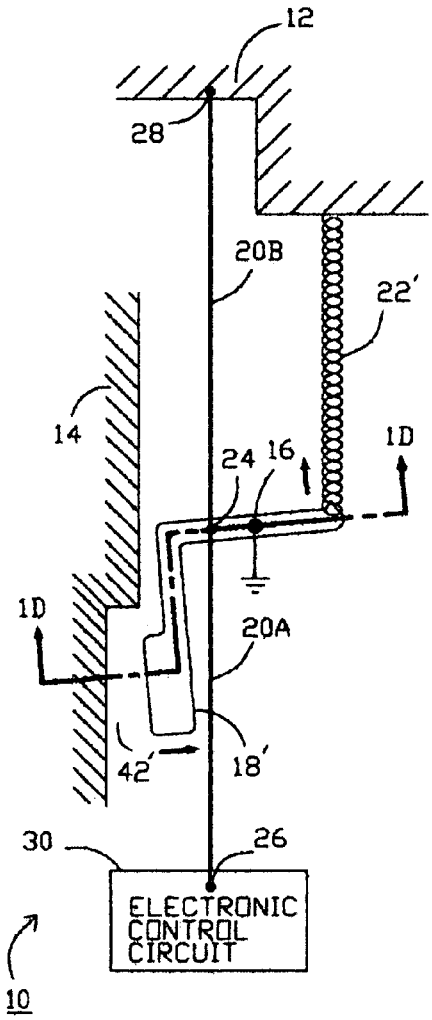
Figure 1B:
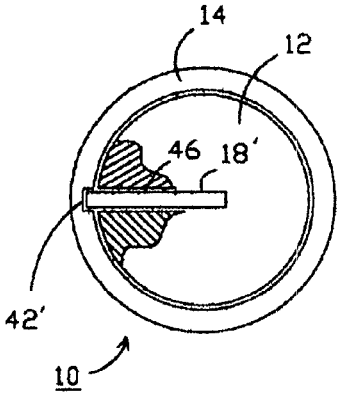

Referring to FIGS. 1A and 1B, the preferred embodiment of the electromechanical lock takes the form of a common mechanical lock cylinder 10 comprising shell 14 and plug 12. Shell 14 and plug 12 both are connected to electrical ground. Electrically conductive gate 18' is disposed inside plug 12 with electrically conductive gate pivot 16. Gate 18' is urged on one side by mechanical biasing means 22', such as a spring, and is connected on the other side through attaching means 24, such as an eyelet, to shape memory metal wire 20, comprising wire segments 20A and 20B, preferably at or around the midpoint of wire 20, at the junction between the two segments. Shape memory metal wire segment 20A is connected at its other end through attaching means 26, such as an eyelet, to electronic control circuit 30. Shape memory metal wire segment 20B at its other end is anchored in the opposite direction to plug 12 by attaching means 28, such as an eyelet. Depending on what is required, the various attaching means 24, 26 and 28 can either be electrically conductive or not.

Figure 1D:
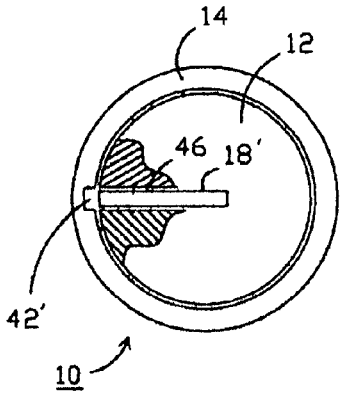

One end of gate 18' is urged into a position inside straight-walled groove 42' of shell 14 by mechanical biasing means 22' pushing at the other end. The same biasing force also stretches shape memory metal wire segment 20A, and causes a slight slack in shape memory wire segment 20B as shown in FIG. 1A. Gate 18' being in groove 42' of shell 14 prevents, or at least limits, the turning of plug 12 inside shell 14, putting lock cylinder 10 in the locked state, as shown in FIG. 1B. To unlock, through attaching means 26 electronic control circuit 30 injects an electrical current that travels through shape memory metal wire segment 20A, attaching means 24, body of gate 18', electrically conductive gate pivot 16, back to body of plug 12, which is electrical ground. This electrical current causes shape memory metal wire segment 20A to heat up and contract, thereby returning shape memory metal wire segment 20B to its original position without slack as shown in FIG. 1C. This contraction rotates the gate 18' about pivot 16, pulls gate 18' out of groove 42' in shell 14, allowing plug 12 to freely rotate in shell 14. The lock cylinder 10 is now in the unlocked state, as shown in FIG. 1D.

To ensure proper service life from shape memory metal wire segment 20A, its elongation at low temperature is kept to low percentages of its total length. Since a known force would stretch a segment of shape memory metal wire of known diameter and length a known percentage, this is achieved in production by controlling the force of mechanical biasing means 22'. The position of attaching means 26 is then finely adjusted so that when in quiescence the blocking end of gate 18' is properly disposed in groove 42' of shell 14, and clears groove 42' of shell 14 when shape memory metal segment 20A contracts.

The other shape memory metal wire segment 20B, preferably but not necessarily a continuation of shape memory metal wire segment 20A, is preferably of substantially equal length as that of segment 20A. If the ambient temperature rises above the transitional temperature of the shape memory metal wire because of high heat, accidental or caused by an attempt at defeating the lock, shape memory metal wire segments 20A and 20B would both contract with opposite and preferably substantially equal forces thereby canceling each other. This leaves mechanical biasing means 22', such as a spring, to urge gate 18' to stay put inside groove 42' of shell 14, thereby keeping lock cylinder 10 in the locked state. While gate 18' is shown as being disposed inside plug 12, it will be understood that this is not required, and the gate may simply be connected to the plug. Alternatively, it may be connected to the shell (or not connected to either the plug or the shell), where the groove 42' would then be defined on the plug surface instead. All such variations are within the scope of the invention.

Figure 2A:
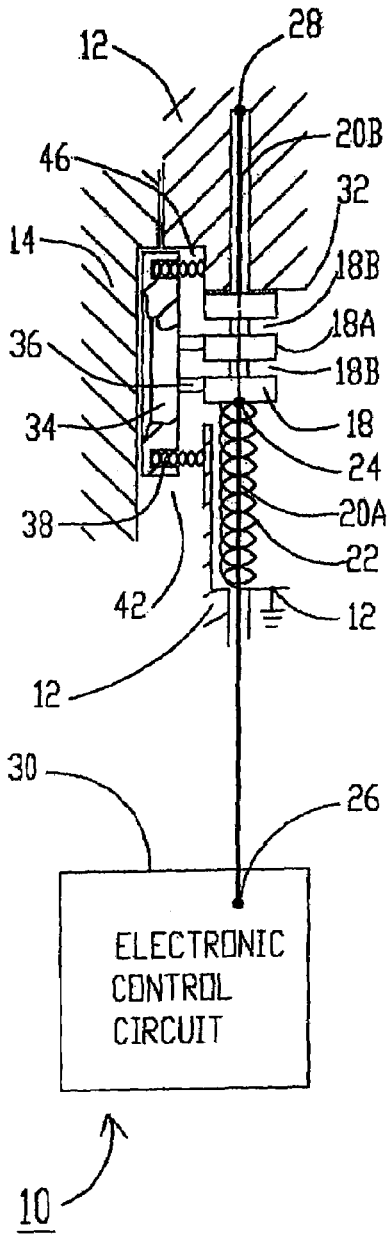
FIG. 2A in plan view, and FIG. 2B in endwise cross-sectional view, show the electronic lock with a different embodiment in the locked state.
Figure 2C:
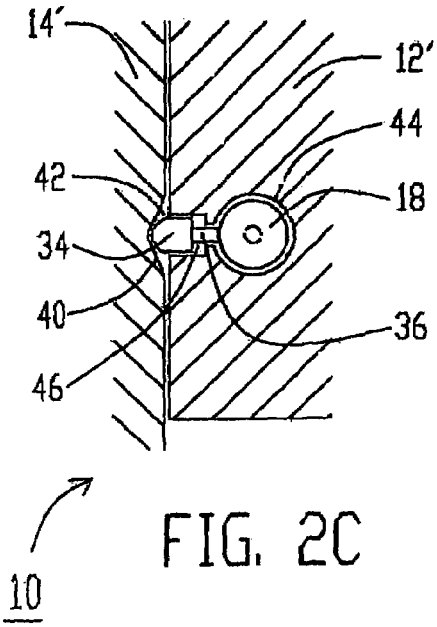
FIG. 2C in endwise cross-sectional view shows the electronic lock in an embodiment in the locked state different from that of FIG. 2B.
Figure 2B:
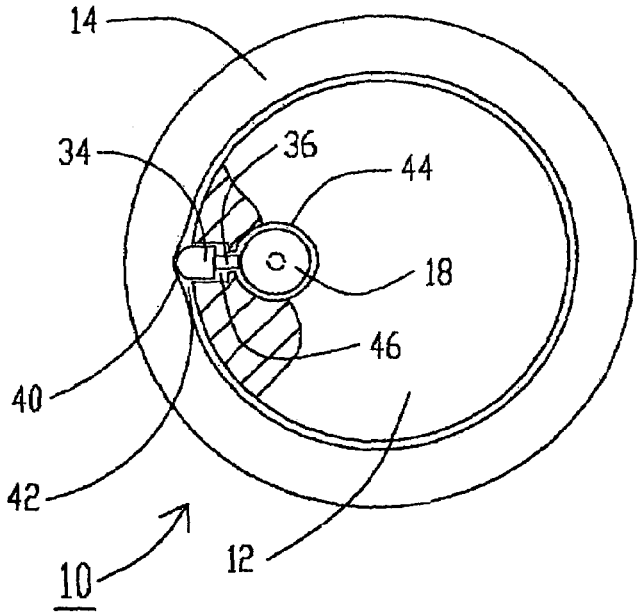

FIGS. 2A and 2B show another preferred embodiment of the present invention in the form of lock cylinder 10, comprising plug 12 inside shell 14. Placed inside bore 44 in plug 12 is gate 18, which is preferably cylindrical in shape. Threaded through a hole along the axis of gate 18, shape memory metal wire 20 is attached at one end by attaching means 26 to electronic control circuit 30, and to the body of plug 12 at the other end by mechanical attaching means 28. Attaching means 24 attaches shape memory metal wire 20 preferably at or around its midpoint to gate 18. Mechanical biasing means 22 which is electrically conductive serves 1.) to urge gate 18 against stop surface 32 of plug 12, and 2.) to connect gate 18 to electrical ground through plug 12. Tumbler 34 incorporating pins 36 sits inside groove 46 in plug 12. Mechanical biasing means 38, such as springs, push tumbler 34 away from plug 12, causing tumbler 34 to butt in quiescence against the bottom surface of groove 42 in shell 14. Tumbler 34 is therefore in a position inside groove 42. Groove 42 is flanked by cam or beveled surfaces 40 that join the groove with inside surface of shell 14, while groove 42' in FIGS. 1A and 1B has straight walls that form corners with inside surface of shell 14. The fact that gate 18' in FIGS. 1A and 1B is different in shape from that of gate 18 in FIGS. 2A and 2B shows that gate 18 can take on any shape as long as it can perform its gating function. For practical applications, gate 18 or 18' generally is no longer than 1" in length.

As shown in FIGS. 2A and 2B, rotating plug 12 causes one of the cam surfaces 40 flanking groove 42 on the inside surface of shell 14 to push tumbler 34, together with pins 36, inwards. Pins 36 soon come into contact with the larger-diameter sections 18A of gate 18 and further inward movement of pins 36 and tumbler 34 is stopped. This in turn stops or at least limits any further turning of plug 12 inside shell 14. Lock cylinder 10 therefore is in the locked state.

Figure 3A:
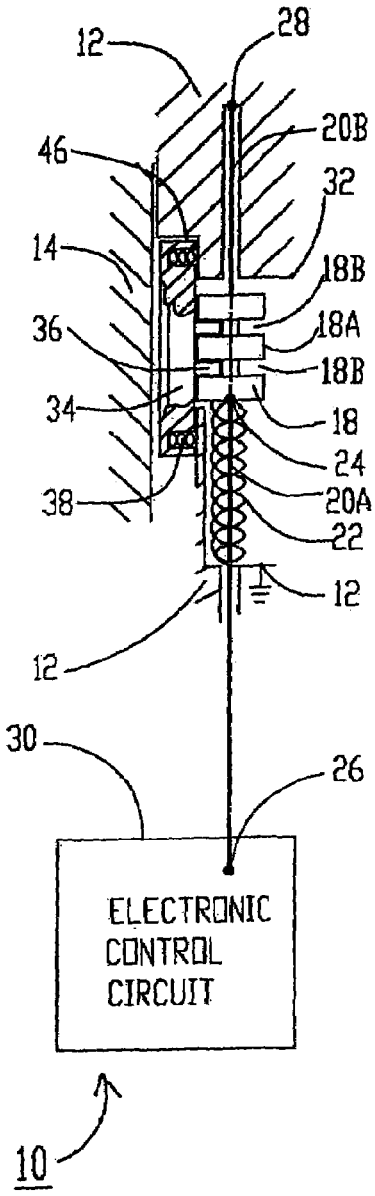
FIG. 3A in plan view, and FIG. 3B in endwise cross-sectional view, show the same embodiment as FIGS. 2A-2B in the unlocked state.
Figure 3C:
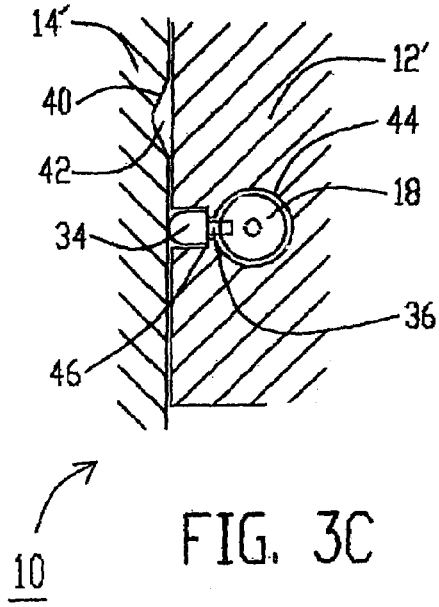
FIG. 3C in endwise cross-sectional view shows the electronic lock in an embodiment in the unlocked state different from that of FIG. 3B.
Figure 3B:
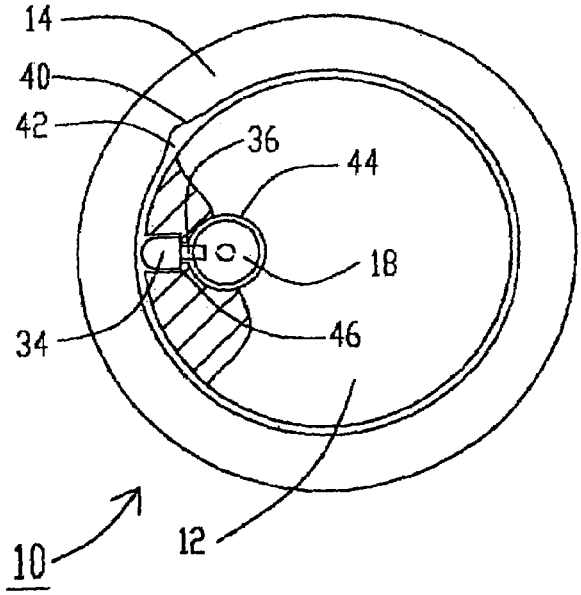

FIGS. 3A and 3B show tumbler 34 of FIGS. 2A and 2B in the free-rotating, unlocked state: electronic control circuit 30 injects, through attaching means 26, electrical current into shape memory metal wire segment 20A, causing it to heat up and contract. In this position, gate 18 aligns its grooves 18B, formed by the sidewalls of larger diameter sections 18A and the surfaces of smaller diameter sections of gate 18, with pins 36 of tumbler 34. Turning plug 12 inside shell 14 causes one of the cam surfaces 40 flanking groove 42 on the inside surface of shell 14 to push tumbler 34 and pins 36 inwards, forcing pins 36 into the grooves 18B of gate 18. Eventually tumbler 34 is pushed beyond groove 42 to ride against the rest of the inside surface of shell 14. Tumbler 34 is then in a position substantially outside of groove 42. This free-rotating state lasts until 1.) tumbler 34 returns first to one of cam surfaces 40, then to groove 42 flanked by cam surfaces 40 and 2.) the cutoff of the electrical current heating shape memory metal wire segment 20A by electronic control circuit 30. This allows segment 20A to cool off and expand, which in turn permits spring 22 to push gate 18 towards stop surface 32, thereby allowing the larger diameter sections 18A to again abut pins 36 of tumbler 34. Springs 38 then again bias tumbler 34 to its position within groove 42, returning lock cylinder 10 to its locked position.

Figure 4:
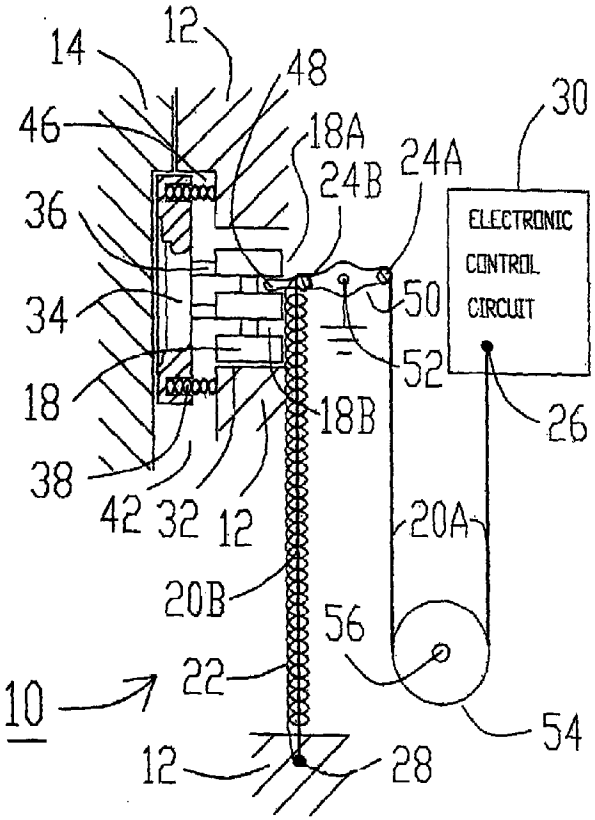

In the embodiments of FIGS. 2A-3B, the gate 18 moves between a first locking position and a second unlocking position, to cause another element such as tumbler 34 to move between corresponding locked and unlocked positions. As described below, in some of the embodiments, gate 18 may not be the only element that is moved between a first locking position and a second unlocking position. To substantially reduce the depth needed to implement the present invention, an alternate embodiment is shown in FIG. 4. Electrically conductive seesaw 50 is mounted to the body of plug 12 with electrically conductive pivot 52. One distal end 48 of seesaw 50 is inserted into one of the grooves 18B in gate 18 so that the reciprocation of seesaw 50 would move gate 18 to a position in contact with or away from stop surface 32. One end of shape memory metal wire segment 20A is attached to one side of seesaw 50 by attaching means 24A, and the other end to electronic control circuit 30 by attaching means 26. One end of another shape memory metal wire segment 20B is attached to the other side of seesaw 50 by attaching means 24B, and the other end to the body of plug 12 by attaching means 28. Mechanical biasing means 22, such as a spring, is secured in parallel to shape memory metal wire segment 20B by the same attaching means 24B and 28. In quiescence, action of mechanical biasing means 22 keeps gate 18 in contact with stop surface 32. The ratio of the distance between attaching means 24A and pivot 52 to that between attaching means 24B and pivot 52 is set to be close to 1:1 so that if both shape memory wire segments 20A and 20B contract simultaneously in high ambient heat, accidental or caused by attempts to defeat the lock, their contracting forces would cancel each other out, leaving mechanical biasing means 22 to keep seesaw 50 and thereby gate 18 in their previously locking position.

For a given reciprocating displacement of gate 18, in order to keep the elongation of shape memory metal wire segment 20A at low temperature to small percentages of its total length, one or both of two optional measures can be taken: 1.) mount pulley 54, made of insulating material, to body of plug 12 with pulley pivot 56 to extend the length of shape memory metal wire 20A; 2.) the ratio of the distance between the distal end 48 of seesaw 50 and conductive pivot 52 to the distance between the exit point of shape memory metal wire segment 20A at attaching means 24A and conductive pivot 52 can be increased. This increases the travel of the distal end 48 of seesaw 50 for a given amount of contraction resulting from heating shape memory metal wire segment 20A. Of course, the length of shape memory wire segment 20B can also be extended if necessary by adding another pulley and pivot similar to pulley 54 and pivot 56.

Lock cylinder 10 as shown in FIG. 4 works in ways similar to those shown in FIGS. 2A, 2B, 3A and 3B. Referring to FIGS. 4 and 2B, in quiescence, shape memory metal wire segment 20A is limp at room temperature, allowing mechanical biasing means 22 to stretch it through seesaw 50. Consequently the distal end 48 of seesaw 50 urges gate 18 against stop surface 32. In this position the larger diameter sections 18A of gate 18 are aligned with pins 36 of tumbler 34. Any effort in turning plug 12 inside shell 14 would cause one of the cam surfaces 40 flanking groove 42 on the inside surface of shell 14 to urge tumbler 34 and pins 36 inwards. Pins 36 of tumbler 34 soon come into contact with larger diameter sections 18A of gate 18 and further inwards movement of pins 36 of tumbler 34 is stopped, thereby stopping any further turning of plug 12 inside shell 14. Lock cylinder 10 is therefore in the locked state.

Figure 5:
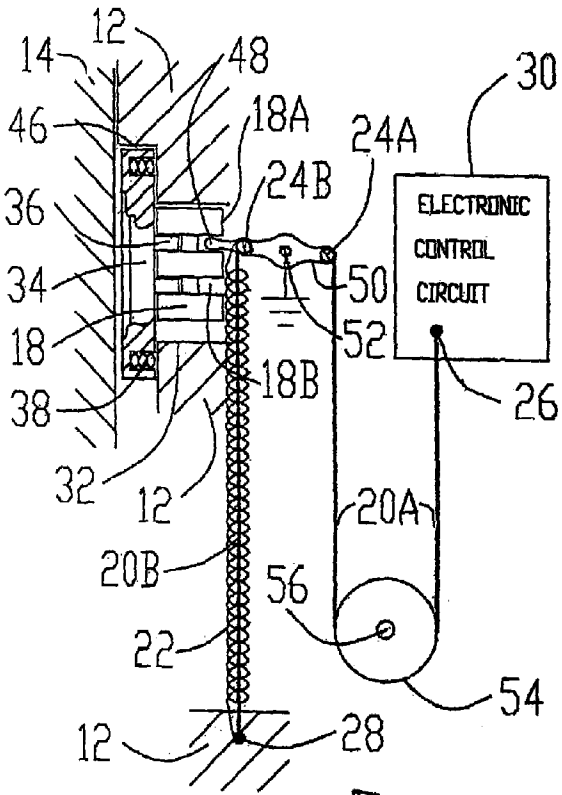
FIGS. 4 and 5 in plan view show the electronic lock with yet another embodiment in locked and unlocked states.

FIGS. 5 and 3B show lock cylinder 10 in the free-rotating, unlocked state. Through attaching means 26 electronic control circuit 30 injects electrical current into shape memory metal wire segment 20A, causing it to heat up and contract. This contraction turns seesaw 50 clockwise and its distal end 48 moves gate 18 away from stop surface 32. In this position, grooves 18B of gate 18 are aligned with pins 36 of tumbler 34. Turning plug 12 inside shell 14 brings one of the cam surfaces 40 flanking groove 42 on the inside surface of shell 14 to urge pins 36 and tumbler 34 inwards, forcing pins 36 into grooves 18B of gate 18. Tumbler 34 eventually moves beyond groove 42 and rides against the rest of the inside surface of shell 14. Lock cylinder 10 is now in the unlocked state.

So far operation of lock cylinder 10 has been monostable—having a single stable quiescent state. However there are applications in which a bistable—having two stable quiescent states—lock is required. Such a bistable lock is shown in the next preferred embodiment in FIGS. 6 and 7.

Figure 6:
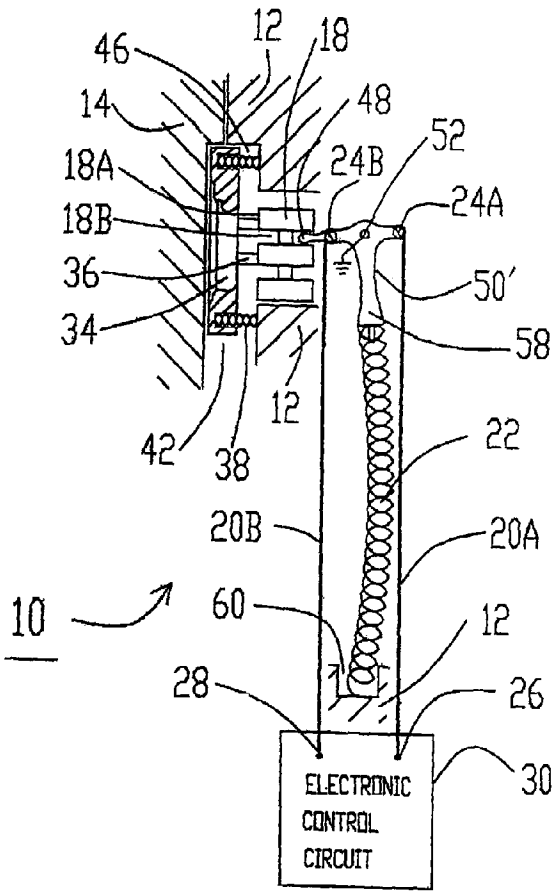

FIGS. 6 and 2B show lock cylinder 10 in the locked state. One end of shape memory metal wire segment 20A is attached to seesaw 50' by attaching means 24A, and the other end to electronic control circuit 30 by attaching means 26. One end of the other shape memory metal wire segment 20B is attached to the opposite side of seesaw 50' by attaching means 24B and at the other end to electronic control circuit 30 by attaching means 28. A modified, "T" shaped seesaw 50' with appendage 58 is cocked into one of two steady states by the off-center force of mechanical biasing means 22, such as a spring. The other end of mechanical biasing means 22 is secured to the body of plug 12 with securing means 60, which in this case may comprise a blind hole in the body of plug 12. The distance between the two surfaces pressing mechanical biasing means 22, one on appendage 58 of seesaw 50' and the other in securing means 60 in the body of plug 12, is shorter than the quiescent length of mechanical biasing means 22. This way, mechanical biasing means 22 is always in a compressed state, urging appendage 58 of seesaw 50' away from securing means 60 in the body of plug 12.

Figure 7:
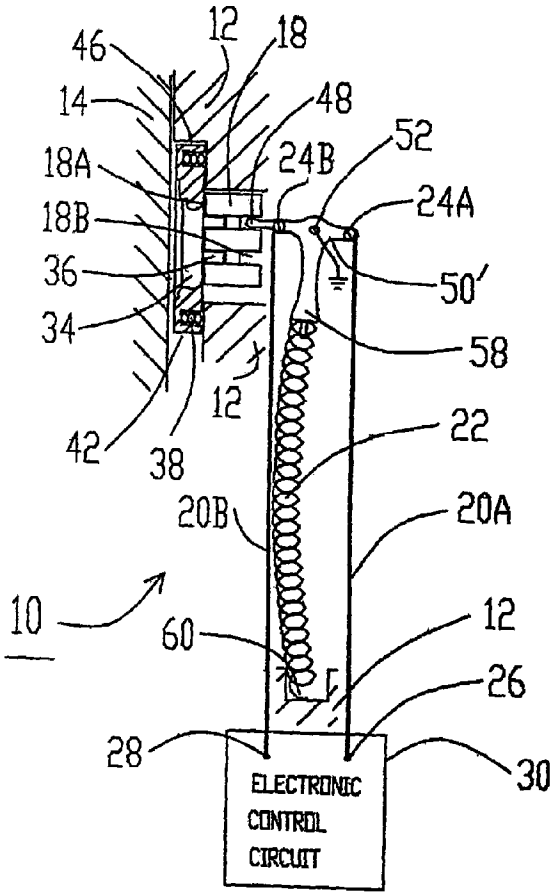
FIGS. 6 and 7 in plan view show the electronic lock with yet another embodiment in locked and unlocked states.

To move lock cylinder 10 from the locked state as shown in FIG. 6 to the unlocked state, through attaching means 26 electronic control circuit 30 injects electrical current into shape memory metal wire segment 20A, causing it to heat up and contract. The clockwise rotation of seesaw 50' caused by this contraction at first further compresses mechanical biasing means 22, which in this phase works against the contraction of shape memory metal wire segment 20A. This process continues until the maximum compression of mechanical biasing means 22 is first reached and then past. Once this point is past, mechanical biasing means 22 turns from resisting to assisting the rotation of seesaw 50' and positive feedback sets in. Seesaw 50' together with gate 18 which is urged by distal end 48 of seesaw 50' snap into the second of their respective bistable positions, as shown in FIG. 7. The quiescent positions of seesaw 50' and hence those of gate 18, are determined by the amount of stretching of the limp shape memory metal wire segments 20A and 20B resulting from the force exerted by mechanical bias means 22. Shape memory metal wire segments 20A and 20B contract momentarily during the transition of seesaw 50' from one to the other steady state and are not required to perform work once the point of positive feedback has been past. Each of the shape memory metal wire segments 20A and 20B plays no part in the amount of stretching of its counterpart. Stop surface 32 and the like therefore is not necessary to define the quiescent positions of gate 18 in a bistable arrangement. In the position as shown in FIG. 7, grooves 18B of gate 18 are aligned with pins 36 of tumbler 34. Turning plug 12 inside shell 14 causes one of the cam surfaces 40 flanking groove 42 on the inside surface of shell 14 to push pins 36 and tumbler 34 inwards, forcing pins 36 into the grooves 18B of gate 18. Eventually tumbler 34 moves beyond groove 42 and rides against the rest of the inside surface of shell 14. Lock cylinder 10 is now in the unlocked state.

In normal lockset operation once the unlocking state is reached plug 12 is rotated inside shell 14 so that a tail piece (not shown) attached to plug 12 would through cam action move a locking bolt external to lock cylinder 10. At the end of this operation, plug 12 would have gone through an angular displacement of 0 (forth and back), 360 (full rotation), or in rare occasions 720 (2 full rotations) degrees. This is how a mechanical key is returned to its top-dead-center after its use and be pulled out from the keyway of a mechanical lockset. It is assumed that lock cylinder 10 would undergo the same amount of rotation and at the end of the operation, tumbler 34 with pins 36 would again return to and be urged into groove 42 of shell 14 by mechanical biasing means 38.

To move lock cylinder 10 from the unlocked state as shown in FIG. 7 back to the locked state as shown in FIG. 6, electrical sensor means (not shown) in electronic control circuit 30 first detects that plug 12 has completed its rotation(s) in shell 14 and through attaching means 28 electronic control circuit 30 injects electrical current into shape memory metal wire segment 20B, causing it to heat up and contract. The counterclockwise rotation of seesaw 50' caused by this contraction at first further compresses mechanical biasing means 22. Mechanical biasing means 22 in this phase works against the contraction of shape memory metal wire segment 20B. This process continues until the maximum compression of mechanical biasing means 22 is first reached and then past. Once this point is past, mechanical biasing means 22 turns from resisting to assisting the rotation of seesaw 50' and positive feedback sets in. Gate 18 snaps into the other bistable position. Since plug 12 has completed its rotation, tumbler 34 is again aligned with groove 42 as shown in FIG. 2B, so that mechanical biasing means 38 pushes tumbler 34 into groove 42 and pins 36 are withdrawn from grooves 18B. This allows gate 18 to be moved by seesaw 50'. In this position, larger diameter sections 18A of gate 18 are aligned with pins 36 of tumbler 34. Turning plug 12 inside shell 14 causes one of the cam surfaces 40 flanking groove 42 on the inside surface of shell 14 to push tumbler 34 and pins 36 inwards. Pins 36 soon come into contact with larger diameter sections 18A of gate 18 and further turning of plug 12 inside shell 14 is stopped. The lock is now back in the locked state.

To guard against unforeseen mishaps in which shape memory metal wire segment 20B is heated before the unlocking rotation of plug 12 in shell 14 is complete, force exerted by mechanical biasing means 38 is made strong enough to overcome the binding frictional force between sidewalls of grooves 18B and pins 36 of tumbler 34 so that when rotation of plug 12 is finally complete, mechanical biasing means 38 would urge tumbler 34 back into groove 42 in shell 14, forcing lock cylinder 10 back into the locked state.

Figure 8:
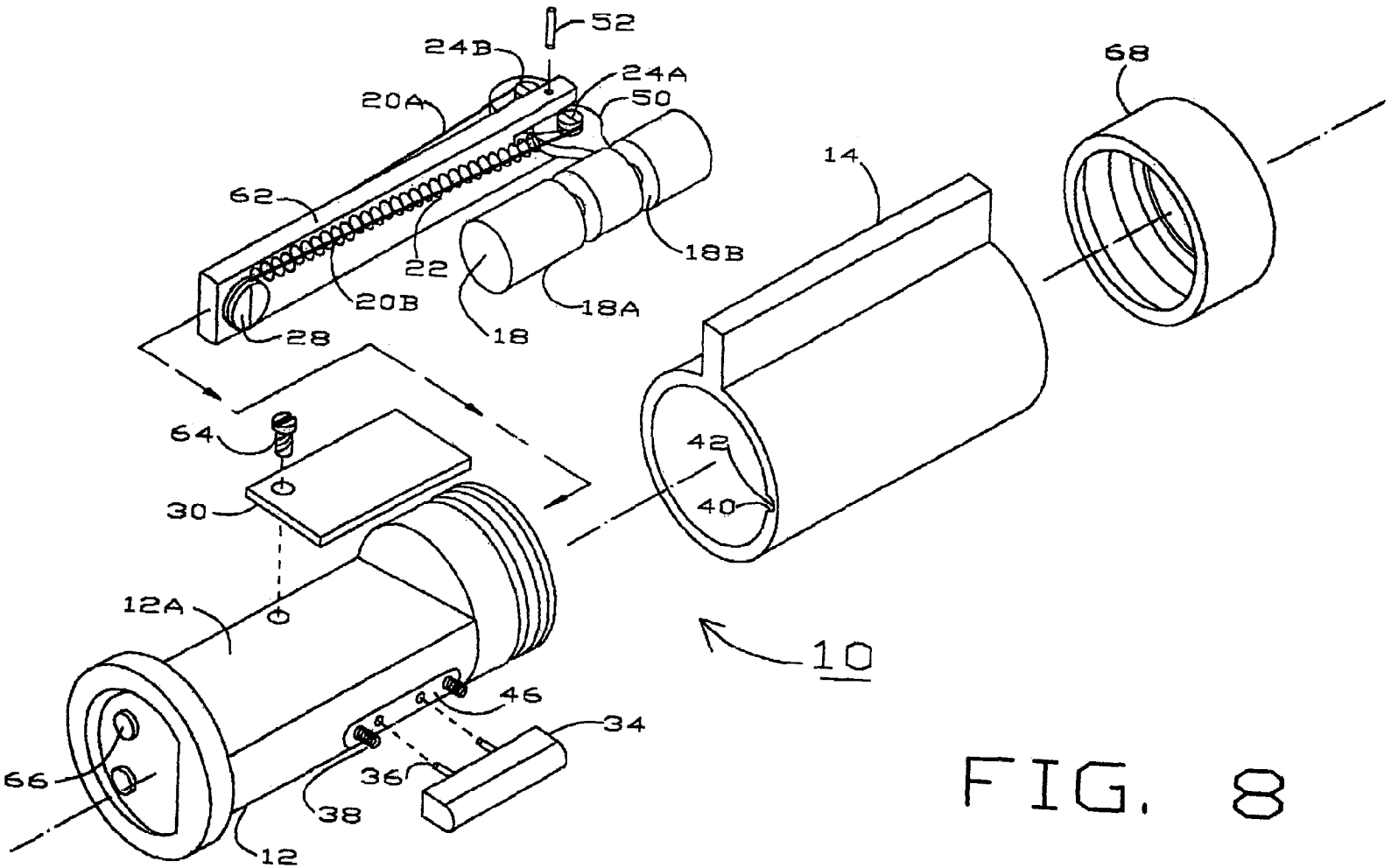
FIG. 8 in isometric view shows one of many ways a lock cylinder incorporating the present invention can be constructed.

FIG. 8 demonstrates one of the ways the preferred embodiments shown in FIGS. 4, 5, 6 and 7 can be mass produced in the form of a standard mechanical lock cylinder 10. To facilitate manufacturing, anchoring stick 62 provides a modular assembly platform for various combinations of a number of, but not limited to, the following components: seesaw 50 (or 50'), conductive pivot 52, attaching means 24A, 24B, 26 and 28, mechanical biasing means 22, pulley 54 with its pivot 56, securing means 60 and shape memory metal wire segments 20A and 20B. Such a module can be fully tested prior to being incorporated in the final assembly with properly engaged gate 18, and more components if necessary, into bores in plug 12. Electronic control circuit 30 in the form of a printed circuit board (PCB) loaded with electronic components is secured with PCB securing means 64, such as a screw, to a flat cutout surface 12A in plug 12, with proper electrical connections (not shown) made to shape memory metal wire segments 20A and/or 20B. Tumbler 34, pins 36, mechanical biasing means 38 and more components if necessary are then placed into slot 46 of plug 12. The completed assembly is then inserted into shell 14. The full assembly is then retained by end cap 68. Electrical contacts 66 in the outside face of plug 12 can provide power and codes from electronic keys (not shown).

Anchoring stick 62 exists mainly for ease of manufacturing. After final assembly it can be regarded as an integral part of plug 12. With this in mind, operation of the electromechanical lock in FIG. 8 has already been expounded in the paragraphs describing the operation of FIGS. 2A, 2B, 3A, 3B, 4, 5, 6 and 7. In its modular form, anchoring stick 62 is a building block that can be dropped into many, many different manufacturing configurations. Therefore embedding anchoring stick 62 in plug 12 disclosed herein should not be construed as limiting the number of settings into which anchoring stick 62 can be integrated.

Figure 9:
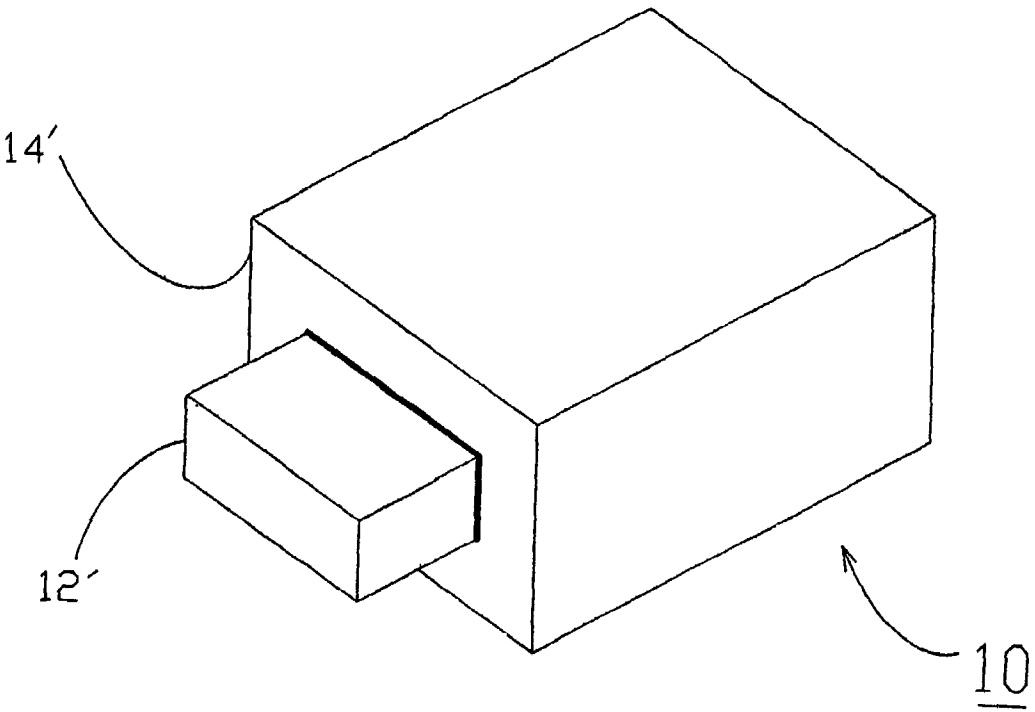
FIG. 9 in isometric view shows the electronic lock implemented with shell-and-plug movement other than rotational.

In some scenarios the shell-and-plug rotational arrangement can be replaced by the linear, sliding displacement of two moveable parts. Referring to FIG. 9, plug 12' takes the form of a rectangular block sliding back and forth inside shell 14', which is also rectangular with a rectangular hollow accommodating plug 12'. FIG. 2C shows the alignment of shell 14' against plug 12' when they are in the locking state, with tumbler 34 blocking the relative sliding movement of shell 14' and plug 12'; FIG. 3C shows the alignment of shell 14' against plug 12' when they are in the unlocking state, with tumbler 34 pushed by one of the cam surfaces 40 of groove 42, resulting in pins 36 of tumbler 34 pushed into groove 18B of gate 18. Tumbler 34 moves beyond groove 42 and rides against the rest of the inside surface of shell 14'. Aside from the fact that the relative movement between shell 14' and plug 12' has become a linear, sliding one, the operation of the rest of the components of lock 10 remains exactly as before, as shown and expounded in FIGS. 2A, 3A, 4, 5, 6 and 7.

Since the locking and unlocking of the electronic lock is affected by the relative rotation or movement of shell 14 (or 14') and plug 12 (or 12') the function can be equally and adequately accomplished by a mirrored arrangement in which groove 42 is placed in plug 12 (or 12') instead of in shell 14 (or 14') and the rest of the assembly put in shell 14 (or 14') instead of plug 12 (or 12').

Thus inherent to the electromechanical lock of this invention is the ruggedness required of a lock to withstand physical abuse while retaining the capacity for miniaturization of the various components in the lock, such as the shape memory metal wire, attaching means (such as crimps, rivets, eyelets or screws and etc.), the seesaw, the anchoring stick. They can be manufactured cost-effectively with micro-machining and assembled manually or with robotics. Such miniaturization also leads to commensurate reduction in power consumption. Such miniaturization is useful to the evolution of future electronic locks that have to be compact, rugged and low-power. With any one of the above embodiments, the wire segment 20A and 20B are stretched by not more than 6%, so that the segments can withstand a large number of unlocking and locking cycles.

It should be noted that since wire segments 20A, 20B are in non-elastic connection with various components in all of the embodiments, there is no need to compensate for the dissipation of the segments' contraction and force caused by connection to any tension spring. Consequently the stretching of the wire segments can be made small, such as not more than 6%. In the case of the embodiments in FIGS. 4-7, it is noted the segments 20A, 20B are rigidly connected to either plug 12, or circuit 30 (which is in turn attached to plug 12) at one end, and to seesaw 50 or 50' at the other. Seesaw 50 or 50', while movable, is pivoted at pivot 52, which is attached or riveted to plug 12. Therefore, segments 20A, 20B are connected to plug 12 non-elastically. Obviously, should the gating mechanism be placed in shell 14, both segments can also be connected in a similar manner to shell 14 instead.

While the above description contains many specificities, these should not be construed as limitations on the scope of the invention, but rather as an exemplification of preferred embodiments thereof. Many additional embodiments are possible, for example, tumbler 34 can take the form of a small ball bearing whose locus is either a dead-end or a through channel along the inside surface of shell 14, with gate 18 as a wedge whose position guides the path of the ball bearing tumbler. In the embodiments of FIGS. 2A-2C, 3A-3C and 4-7, while gate 18 and tumbler 34 are shown as being disposed inside plug 12, it will be understood that this is not required, and they may simply be connected to the plug. Alternatively, they may be connected to the shell, where the groove 42 would then be defined on the plug surface instead. Gate 18 also need not be connected to either the plug or the shell. All such variations are within the scope of the invention.

Accordingly, the scope of the invention should be determined not by the embodiments illustrated, but by the appended claims and their legal equivalents. All references referred to herein are incorporated herein by reference in their entireties.

It is claimed:

1. An electronic lock comprising:

a shell having a bore therein;

a plug disposed in said bore of said shell;

a groove in either said shell or said plug;

a gate connected to said plug or said shell wherein when said gate enters said groove in a locked position, it limits movement of said plug relative to said shell;

a mechanism biasing said gate into the locked position;

a first shape memory metal wire segment with a transition temperature that moves said gate from the locked position to an unlocked position away from the groove in response to an electrical current therein;

an electronic control circuit for injecting electrical current into said first shape memory metal wire segment to unlock the lock;

a second shape memory metal wire segment with said transition temperature arranged to contract concurrently with opposite force to that caused by contraction of said first shape memory metal wire segment when ambient temperature rises above said transition temperature of said shape memory metal wires so that said gate is retained in the locked position by said mechanism.

2. An electronic lock as claimed in claim 1 wherein said mechanism is a spring.

3. An electronic lock as claimed in claim 1 wherein the second shape memory metal wire segment is arranged to contract concurrently with substantially equal force to that caused by contraction of said first shape memory metal wire segment when ambient temperature rises above said transition temperature of said shape memory metal wires.

4. An electronic lock comprising:

a shell having a bore therein;

a plug disposed in said bore of said shell;

a groove in either said shell or said plug;

a gating mechanism having a member connected to said plug or said shell, wherein when said member enters said groove in a locked position, it limits movement of said plug relative to said shell;

a first device biasing said gating mechanism so that the member is in the locked position;

at least one first shape memory metal wire segment with a transition temperature in non-elastic connection with said plug or said shell, said at least one first shape memory metal wire segment moving said gating mechanism or a component thereof from a first locking position to a second unlocking position in response to an electrical current in the at least one first shape memory metal wire segment and causing the member to be withdrawn from the locked position in the groove; and an electronic control circuit for injecting electrical current into said at least one first shape memory metal wire segment to unlock the lock; and said gating mechanism is connected to a second share memory metal wire segment that contracts concurrently with substantially equal but opposite force to that caused by contraction of said first shape memory metal wire segment when ambient temperature rises above said transition temperature of said shape memory metal wire segments so that said member is retained in the locked position by said first device.

5. The lock of claim 4, wherein said plug and/or said shell rotate(s) or slide(s) relative to each other when the member is moved between the locked and unlocked positions.

6. The lock of claim 4, wherein said at least one first shape memory metal wire segment is stretched by not more than about 6% when said gating mechanism is moved between the first locking position and the second unlocking position.

7. The lock of claim 4, wherein said gating mechanism comprises a component including a gate that is moved by the at least one first shape memory metal wire segment and said first device between at least the first and second positions, wherein when the gate is in the first position, the member is prevented from moving away from a position inside the groove to a position substantially outside the groove, so that relative motion between said plug and said shell is limited, and when the gate is in the second position, the member is permitted to move from the locked position inside the groove to another position to allow relative motion between said plug and said shell.

8. The lock of claim 6, wherein said gating mechanism comprises a component including a gate of at least two first sections and at least one second section between the at least two first sections, said at least one second section smaller than the first sections, and wherein when the gate is in the first position, at least one of the first sections abuts the member and prevents the member from moving away from the groove, and when the gate is in the second position, the at least one second section is adjacent to the member and permits the member to move away from the groove.

9. The lock of claim 8, said gating mechanism further comprising at least one second device biasing said member away from said groove, wherein the at least one of the first sections abutting said member prevents said member from moving away from said groove against action of the at least one second device, and the at least one second device moves said member away from said groove when said member is adjacent to the at least one second section.

10. The lock of claim 9, said a second shape memory metal wire segment in non-elastic connection with said plug or said shell.

11. The lock of claim 4, said first device biasing said gating mechanism or a component there of into the first position.

12. An electronic lock comprising:

a shell having a bore therein;

a plug disposed in said bore of said shell;

a groove in either said shell or said plug;

a gating mechanism having a member connected to said plug or said shell, wherein when said member enters said groove in a locked position, it limits movement of said plug relative to said shell;

a first device biasing said gating mechanism;

at least one first shape memory metal wire segment with a transition temperature moving said gating mechanism, so that said member is moved from the locked position to an unlocked position in response to an electrical current in the at least one first shape memory metal wire segment; and an electronic control circuit for injecting electrical current into said at least one first shape memory metal wire segment to unlock the lock, wherein the at least one first shape memory metal wire segment is stretched by not more than 6% between the locked and the unlocked positions; and said gating mechanism is connected to a second shape memory metal wire segment that contracts concurrently with substantially equal but opposite force to that caused by contraction of said first share memory metal wire segment when ambient temperature rises above said transition temperature of said share memory metal wire segments so that said member is retained in the locked position by said first device.

13. The lock of claim 12, wherein said at least one first shape memory metal wire segment is in non-elastic connection with said plug or said shell.

14. The lock of claim 12, wherein said plug and/or said shell rotate(s) or slide(s) relative to each other when the member is moved between the locked and unlocked positions.

15. A method of electronically locking and unlocking, comprising:

(a) providing an electronic lock comprising:

a shell having a bore therein;

a plug disposed in said bore of said shell;

a groove in either said shell or said plug;

a gating mechanism having a member connected to said plug or said shell, wherein when said member enters said groove in a locked position, it limits movement of said plug relative to said shell;

a first device biasing said gating mechanism; and at least one first shape memory metal wire segment with a transition temperature moving said gating mechanism, so that said member is moved from the locked position to an unlocked position in response to an electrical current in at least one first shape memory metal wire segment; and a second shape memory metal wire segment connected to said gating mechanism so that said second shape memory metal wire segment contracts concurrently with substantially equal but opposite force to that caused by contraction of said first shape memory metal wire segment when ambient temperature rises above said transition temperature of said shape memory metal wire segments so that said member is retained in the locked position by said first device; and (b) injecting electrical current into said at least one first shape memory metal wire segment to unlock the lock, wherein the at least one first shape memory metal wire segment is stretched by not more than 6% between the locked and unlocked positions.

16. A method of electronically locking and unlocking, comprising:

(a) providing an electronic lock comprising:

a shell having a bore therein;

a plug disposed in said bore of said shell;

a groove in either said shell or said plug;

a gating mechanism having a member connected to said plug or said shell, wherein when said member enters said groove in a locked position, it limits movement of said plug relative to said shell;

a first device biasing said gating mechanism; and at least one first shape memory metal wire segment with a transition temperature moving said gating mechanism from the locked position to an unlocked position in response to an electrical current in the at least one first shape memory metal wire segment; and a second shape memory metal wire segment connected to said gating mechanism so that said second shape memory metal wire segment contracts concurrently with substantially equal but opposite force to that caused by contraction of said first shape memory metal wire segment when ambient temperature rises above said transition temperature of said shape memory metal wire segments so that said gating mechanism is retained in the locked position by said first device; and (b) injecting electrical current into said at least one first shape memory metal wire segment to unlock the lock, wherein said providing includes connecting said at least one first shape memory metal wire segment non-elastically directly or indirectly with said plug or said shell.

* * * * *